United States Patent [19]

Takegawa et al.

[11] Patent Number: 4,949,759

[45] Date of Patent: Aug. 21, 1990

[54] SEERSUCKER LOOM WITH TENSION REGULATION OF PUCKERING WARP

[75] Inventors: Yujiro Takegawa, Kahoku; Kenjiro Ohno, Kanazawa; Fumio Matsuda, Kanazawa; Zenji Tamura, Kanazawa, all of Japan

[73] Assignee: Tsudakowa Corp., Ishikawa, Japan

[21] Appl. No.: 385,417

[22] Filed: Jul. 26, 1989

[30] Foreign Application Priority Data

Jul. 27, 1988 [JP] Japan ..... 63-187590

[51] Int. Cl.[5] ..... D03D 39/22; D03D 49/10

[52] U.S. Cl. ..... 139/25; 139/102; 139/110; 139/369

[58] Field of Search ..... 139/24, 25, 110, 102, 139/369, 358, 353

[56] References Cited

U.S. PATENT DOCUMENTS 2,489,231 11/1949 Bourque ..... 139/24
3,920,052 11/1975 Nelson ..... 139/102 X
4,569,373 2/1986 Vogel ..... 139/25
4,827,985 5/1989 Sugita et al. ..... 139/25

*Primary Examiner*—Andrew M. Falik
*Attorney, Agent, or Firm*—Wenderoth, Lind & Ponack

[57] ABSTRACT

A seersucker loom is arranged such that puckering warp yarns are divided to form a shed during the weaving of a seersucker. The tension of the puckering warp yarns is maintained on a level below that of the tension of the ground warp yarns. The puckering warp yarns are slackened positively at least during a slackening period from a shed closing operation to a beating-up operating of every turn of the main shaft of the seersucker loom so that the tension of the puckering warp yarns are reduced to a value which below a predetermined tension of the yarns during a period other than during the slackening period. This enables the loom to slacken portions of the puckering warp yarns near the cloth fell sufficiently during the beating-up operation so that the puckering warp yarns are satisfactorily puckered.

6 Claims, 9 Drawing Sheets

SEERSUCKER LOOM WITH TENSION REGULATION OF PUCKERING WARP

BACKGROUND OF THE INVENTION

1. Field of the Invention:

The present invention relates to a seersucker weaving method and a seersucker loom. A seersucker is a plain-woven fabric having ground warp yarns and undulatory puckering warp yarns. Therefore the length of the puckering warp yarns woven in the seersucker is greater than that of the ground warp yarns woven in the same seersucker. A seersucker of a higher grade has greater undulations than that of a lower grade of seersucker.

2. Description of the Prior Art:

In a known seersucker weaving method such as disclosed in Japanese Laid-Open Patent Publication No. 53-65456, the length of the puckering warp yarns let off for every let-off cycle is greater than that of the ground warp yarns let off in the same let-off cycle, and the tension of the puckereing warp yarns is varied periodically at a period corresponding to several turns of the main shaft of the seersucker loom. When the puckering warp yarns are let off and the tension of the puckering warp yarns is controlled in such a manner, the puckering warp yarns slacken excessively during a low-tension period in which the tension of the puckering warp yarns is reduced if the length of the puckering warp yarns let off is much larger than that of the ground warp yarns and, consequently, the loom is unable to carry out a normal weaving operation because of the fact that the puckering warp yarns are woven in the fabric in loops, and then the droppers of the warp stop motion device engaging the puckering warp yarns drop to stop the loom or alternatively, a faulty shedding and the resultant faulty picking occurs. If the tension of the puckering warp yarns during a high-tension period in which the tension of the puckering warp yarns is increased is very high, it is impossible to weave a satisfactory seersucker because the length of the puckering warp yarns let off is absorbed by the elastic contraction of the puckering warp yarns and hence the puckering warp yarns are unable to be undulated to in a sufficiently high degree.

Thus, the known seersucker weaving method has problems in weaving a seersucker both when the length of the puckering warp yarns let off for every let-off cycle is comparatively large and when the tension of the puckering warp yarns is comparatively high. Accordingly, in any case, it is impossible to weave a seersucker on a high-speed loom, such as a water jet loom or an air jet loom, by this known seersucker weaving method.

SUMMARY OF THE INVENTION

Accordingly, it is an object of the present invention to provide a seersucker weaving method eliminating the drawbacks of the conventional seersucker weaving method and enabling the high-speed weaving of a seersucker of a high grade.

It is another object of the present invention to provide a seersucker loom having a mechanism and a controller capable of weaving a seersucker of a high grade.

It is a technically important requirement of weaving a seersucker to slacken sufficiently portions of the puckering warp yarns near the cloth fell in beating up a weft yarn. If the puckering warp yarns are slackened continuously during one turn or several turns of the main shaft of the seersucker loom, the problems residing in the foregoing known seersucker weaving method will inevitably arise. The disadvantages of the known seersucker weaving method can be eliminated and the foregoing important technical requirement of seersucker weaving can be satisfied by slackening the puckering warp yarns only during a particular period in one turn of the main shaft, such as a period between a shed closing operation and a beating-up operation (hereinafter referred to as a "slackening period").

From such knowledge, a seersucker weaving method in accordance with the present invention holds the puckering warp yarns at a predetermined tension lower than that of the ground warp yarns while the puckering warp yarns are divided to form a shed during one turn of the main shaft of the seersucker loom, and then slackens the puckering warp yarns positively to a tension below the predetermined tension during the slackening period so that portions of the puckering warp yarns near the cloth fell are slackened sufficiently. The puckerig warp yarns are slackened intermittently once every several turns, or more preferably, once every turn, of the main shaft of the seersucker loom.

Since the puckering warp yarns are slackened at least during the short slackening period and a weft yarn is beaten up after being interlaced with the puckering warp yarns and the ground warp yarns, the puckering warp yarns are not woven in loops and a satisfactorily puckered seersucker is woven. Particularly, since the slackening operation is timed so that the puckering warp yarns are slackened effectively, the puckering warp yarns are slackened properly without being affected by the shedding motion. The puckering warp yarns may be tightened again at the time when the shedding operation is normally completed for the next picking operation.

In this specification, a "shed closing time" means a time period in which the puckering warp yarns are slackened effectively with a moderate frictional resistance against the movement of the weft yarn relative to the puckering warp yarns, and a "beating time" means a time period in which a weft yarn is beaten up firmly in the cloth fell and the puckering warp yarns are stabilized in the cloth fell in a puckered state.

Ordinarily, puckering warp yarns are let off through a tension roller and are extended to the cloth fell through droppers and rollers. The puckering warp yarns can be slackened by positively displacing the tension regulating elements including the tension roller, the droppers and/or the rollers by means of mechanical devices, such as a cam device and an air cylinder actuator, or electrical devices, such as a motor and a solenoid actuator.

These tension regulating elements operate during the short slackening period. The movement of the tension regulating elements and the resultant tension of the puckering warp yarns need not necessarily be constant and may be varied periodically at a period corresponding to several turns of the main shaft of the seersucker loom. The periodic variation of the tension or the movement of the tension regulating elements can be achieved by electrical or mechanical control means. Such a periodic variation of the tension of the puckering warp yarns causes a periodic variation in the puckering mode of the puckering warp yarns to further improve the quality of the seersucker.

According to the present invention, the puckering warp yarns are slackened effectively in the short slackening period and, consequently, a weft yarn pulls the puckering warp yarns frictionally when beaten up to weave the puckering warp yarns, of a length which is larger than that of the ground warp yarns, into the structure of a fabric, so that a seersucker of a high grade having sufficiently large puckers can be produced. Since the puckering warp yarns are slackened only in the short slackening period and the puckering warp yarns are tightened at a predetermined tension during the rest of time, the puckering warp yarns are not slackened excessively. Accordingly, the droppers of the warp stop motion device are unable to drop erroneously and faulty shedding will not occur. Since the puckering warp yarns are tightened at a predetermined high tension except during the short slackening period the short puckering warp yarns can be operated for shedding at a high speed and hence a seersucker can be woven on a high-speed loom, such as a water jet loom or an air jet loom.

Furthermore, when an electric control circuit is employed to control the movement of the tension regulating elements of the seersucker loom or the tension of the puckering warp yarn, the desired torque or the desired movement of the tension regulating elements can be readily set, and hence the puckering ratio of the puckering warp yarns and the period of variation of the puckering ratio can be readily changed in preparing the seersucker loom for a weaving operation or during the weaving operation of the seersucker loom.

The above and other objects, features and advantages of the present invention will become more apparent from the following description taken in conjunction with the accompanying drawings.

DETAILED DESCRIPTION OF THE PREFERRED EMBODIMENTS

Figure 1:
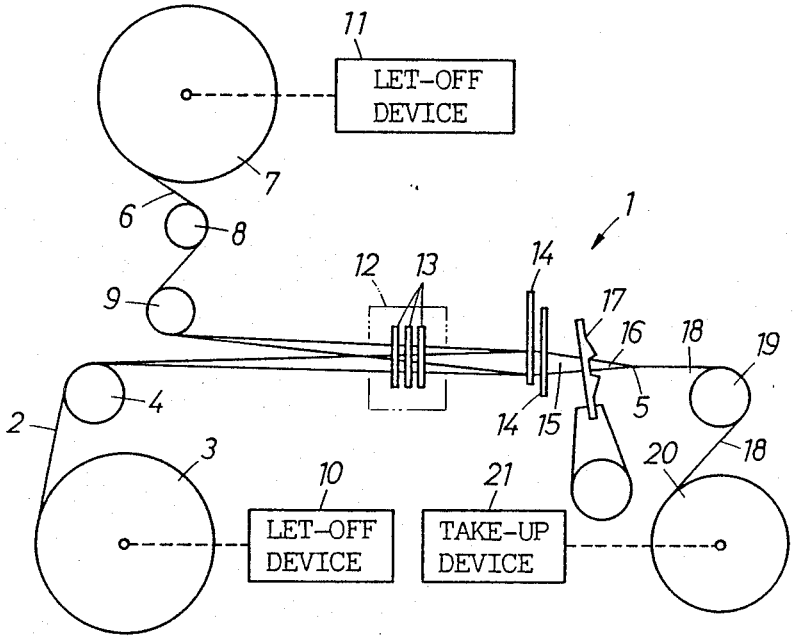
FIG. 1 is a shematic side elevation of a seersucker loom in accordance with a first embodiment of the present invention.
Figure 2:
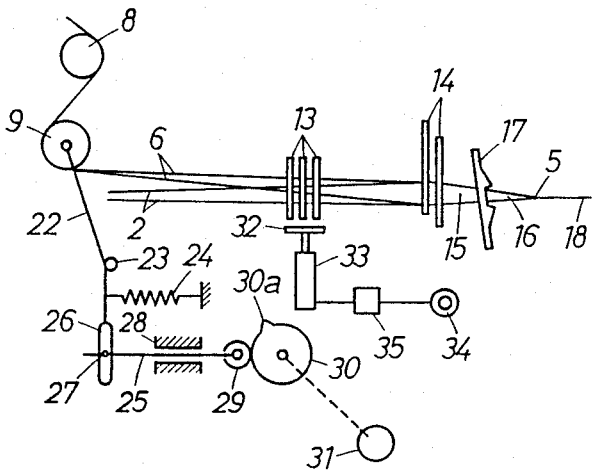
FIG. 2 is a schematic side elevation of an essential portion of the seersucker loom of FIG. 1.
Figure 3:
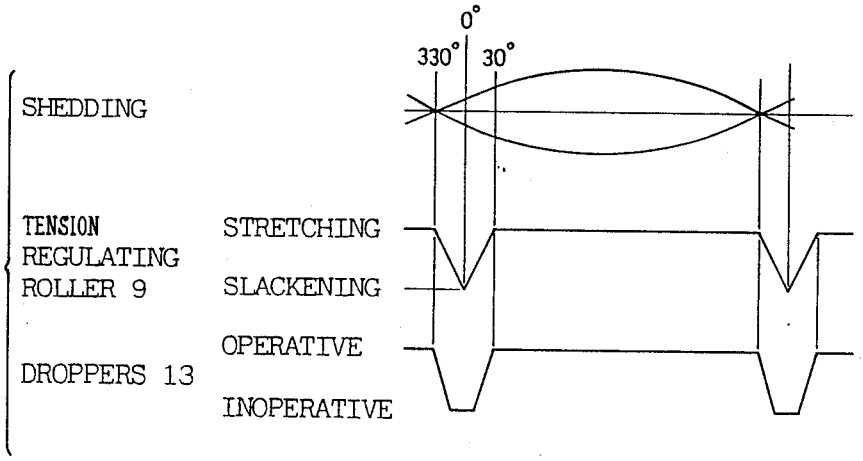
FIG. 3 is a timing chart of assistance in explaining the weaving operation of the seersucker loom of FIG. 1.

First Embodiment (FIGS. 1, 2 and 3)

Referring to FIG. 1 showing the basic constitution of a seersucker loom 1, puckering warp yarns 6 are let off from an upper warp beam 7 in a warp into a puckering weave section through a guide roller 8 and a tension regulating roller 9 and are extended to the cloth fell 5, and ground warp yarns 2 are let off from a lower warp beam 3 in the warp into a weave section other than the puckering weave section through a tension regulating roller 4 and are extended to the cloth fell 5. The lower warp beam 3 and the upper warp beam 7 are driven by known mechanical or electrical let-off devices 10 and 11, respectively, for positive or negative let-off.

The ground warp yarns 2 and the puckering warp yarns 6 are passed through droppers 13 of a warp stop motion device 12, and are divided by heddles 14 to form a shed 15 in picking a weft yarn 16. The picked weft yarn 16 is interlaced with the ground warp yarns 2 and the puckering warp yarns 6 and beaten up to the cloth fell 5. A seersucker 18 thus woven is delivered through a cloth roller 19 and is wound on a cloth beam 20. The cloth beam 20 is driven for winding the seersucker 18 by a known take-up device 21.

As shown in FIG. 2, a vertically movable support plate 32 is disposed under the droppers 13. The support plate 32 is raised by an air cylinder actuator 33 to hold the droppers 13 inoperative for a necessary period by supporting the droppers 13. The air cylinder actuator 33 is connected to a compressed air source 34 and is controlled, for example, by a solenoid valve 35.

As shown in FIG. 2, the tension regulating roller 9 for regulating the tension of the puckering warp yarns 6 is supported rotatably on one end of each of a pair of levers 22 disposed at the opposite ends of the tension regulating roller 9. In FIG. 2, only one of the levers is shown. Each lever 22 is supported pivotally on a shaft 23 so as to by moved toward the cloth fell 5 to slacken the puckering warp yarns 6. The lever 22 is biased counterclockwise by a spring 24. A rod 25 has one end connected to the other end of the lever 22 with a pin 27 which is slidably fitted in a slot 26 formed in the other end of the lever 22 and the other end of the rod 25 is rotatably supporting a cam follower 29 which is in contact with the cam surface of a plate cam 30; the rod 25 is supported so as to be axially slidable in a guide 28. The plate cam 30 has a circular profile having a protrusion **30*a*. The plate cam 30 is interlocked with the main shaft 31 of the seersucker loom 1 so as to be rotated one full turn at a constant speed while the main shaft 31 rotates one full turn. The protrusion 30*a* of the plate cam 30 is formed so as to impart motion to the cam follower 29 during a slackening period between a shed closing operation and a beating-up operation in one full turn of the main shaft 31 corresponding, for example, to the period of rotation of the main shaft 31 from a phase angle of 330° to a phase angle of 30°. The throw of the plate cam 30, namely, the height of the protrusion 30*a*, is determined properly taking into account the lever ratio of the lever 22 so as to give the tension regulating roller 9** a predetermined displacement.

During the weaving operation, the ground warp yarns 2 and the puckering warp yarns 6 are let off gradually. The puckering warp yarns 6 are let off at a let-off rate, namely, a length let off per unit time, which is 1.1 to 1.6 times a let-off rate at which the ground warp yarns 2 are let off. When the ground warp yarns 2 and the puckering warp yarns 6 are divided to form a shed 15, a weft yarn 16 is inserted across the shed 15, and the shed 15 is then closed, and then the weft yarn 16 is beaten up by a reed 17 to weave a seersucker 18.

FIG. 3 shows the timing of the shedding motion and the beating-up motion. In this embodiment, the beating-up phase angle is 0°. During the weaving operation, the cam 30 advances the tension regulating roller 9 toward the cloth fell 5 through the cam follower 29, the rod 25 and the lever 22 to slacken the puckering warp yarns 6 positively for the short slackening period from the phase angle of 330° to the phase angle of 30°, namely, a phase angle of 30° after the beating-up operation, once every turn of the main shaft 31, namely, during every picking cycle. The tension of the puckering warp yarns 6 during the slackening period is far less than the tension thereof during the rest of the period. The tension regulating roller 9 is returned to the initial position upon the termination of the slackening period to tighten the puckering warp yarns 6 to the predetermined tension. During the slackening period, the support plate 32 is raised to support the droppers 13 so that the warp stop motion device 12 is held inoperative. When the support plate 32 supports the droppers 13, the weight of the droppers 13 is removed from the associated ground warp yarns 2 and the puckering warp yarns 6, so that the tension of the ground warp yarns 2 and the puckering warp yarns 6 is reduced accordingly. However, the tension of the ground warp yarns 2 is regulated to maintain a constant tension. Since the puckering warp yarns 6 extend substantially linearly along the warp line and the weight of the droppers 13 is removed from the puckering warp yarns 6 while the droppers 13 are supported by the support plate 32, portions of the puckering warp yarns 6 near the cloth fell 5 are slackened effectively, the weft yarn 16 drags the puckering warp yarns 6 frictionally toward the cloth fell 5 when beaten up by the reed 17, so that the length of the puckering warp yarns 6 woven into the seersucker 18 in each weaving cycle is longer than that of the ground warp yarns 2 woven into the seersucker 18 at the same time. Moreover, since the puckering warp yarns 6 are woven in such a manner in every weaving cycle, the seersucker 18 has uniform undulations of a high grade.

Although this embodiment employs the mechanism for moving the tension regulating roller 9 and the mechanism for supporting the droppers 13 in combination to slacken the puckering warp yarns 6 positively, the latter mechanism may be omitted when necessary. The warp stop motion device 12 may be held electrically inoperative only during the slackening period to prevent the erroneous warp yarn breakage detection by the droppers 13 when the puckering warp yarns 6 are slackened positively.

Figure 4:
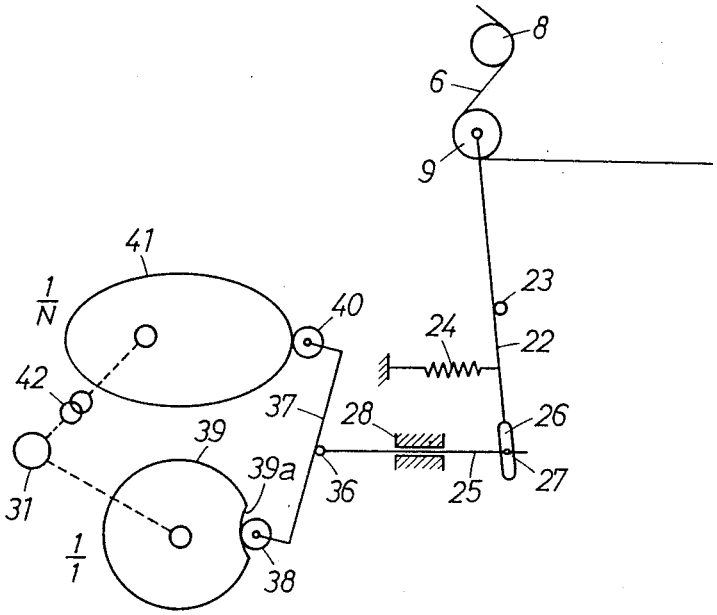
FIGS. 4, 5 and 6 are diagrammatic illustrations of respective essential portions of seersucker looms in accordance with second, third and fourth embodiments of the present invention, respectively.

Second Embodiment (FIG. 4)

The first embodiment slackens the puckering warp yarns 6 positively by the same degree once every turn of the main shaft 31, namely, during every picking cycle. The second embodiment varies the slackening degree continuously at a period corresponding to several turns to the main shaft 31.

Referring to FIG. 4, a tension regulating roller 9 is supported rotatably on one end of each of a pair of levers 22 disposed at the opposite ends of the tension regulating roller 9. A rod 25 is supported for axial movement on a guide 28 and has one end provided with a pin 27 slidably engaging a slot 26 formed in one end of each lever 22, and the other end of the rod 25 is pivotally joined by a pin 36 to the middle of a lever 37. The lever 37 has one end supporting a cam follower 38 engaging a cam 39 and the other end supporting a cam follower 40 engaging an elliptic cam 41. The elliptic cam 41 is interlocked with the main shaft 31 by a reduction gear train 42 having a reduction ratio of 1/N, so that the elliptic cam 41 rotates once every N turns of the main shaft 31.

The cam 39, similarly to the cam 30 of the first embodiment, is a circular plate cam having a recess **39*a* to reciprocate the lever 22 once every one full turn of the main shaft 31. Therefore, the puckering warp yarns 6 are slackened once every picking cycle by the cam 39. Since the elliptic cam 41 rotates once every N turns of the main shaft 31, the position of the pin 36 varies periodically at a period corresponding to N turns of the main shaft 31. Consequently, the length of the puckering warp yarns 6 woven into the seersucker 18 in every picking cycle varies periodically according to the periodic variation of the tension of the puckering warp yarns 6 and accordingly, the degree of puckering of the puckering warp yarns 6** varies periodically.

Figure 5:
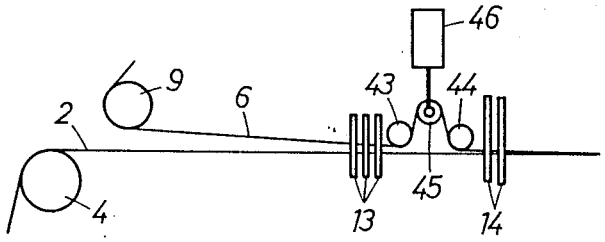

Third Embodiment (FIG. 5)

In the first and second embodiments, the tension regulating roller 9 is displaced by a mechanical device for the slackening period. The puckering warp yarns 6 can be slackened by another mechanical means without moving the tension regulating roller 9.

Referring to FIG. 5, two guide rollers 43 and 44 are disposed between the droppers 13 and the heddles 14, and a tension regulating roller 45 is disposed for vertical movement between the guide rollers 43 and 44. The tension regulating roller 45 is supported on the extremities of the piston rods of air cylinder actuators 46. The tension regulating roller 45 is moved downward at least during the slackening period once every picking cycle to slacken the puckering warp yarns 6 positively.

Figure 6:
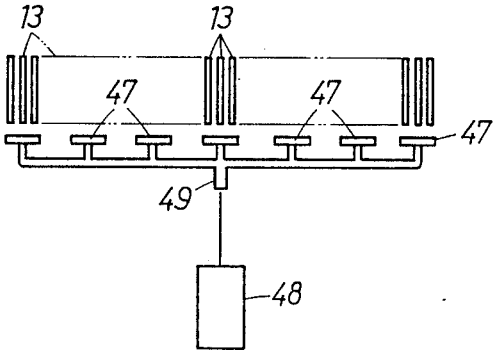

Fourth Embodiment (FIG. 6)

The fourth embodiment employs a puckering warp yarn slackening mechanism including support plates 47, arranged across the warp on a support member 49 respectively at positions corresponding to droppers 13 for the puckering warp yarns 6, and an air cylinder actuator 48 for vertically moving the support member 49.

The support plates 47 are moved upward to raise only the droppers 13 associated with the puckering warp yarns 6 and, consequently, the weight of the droppers 13 is removed from the corresponding puckering warp yarns 6 during the slackening period to slacken the puckering warp yarns 6 positively, while the droppers 13 associated with the ground warp yarns 2 remains operative.

Figure 7:
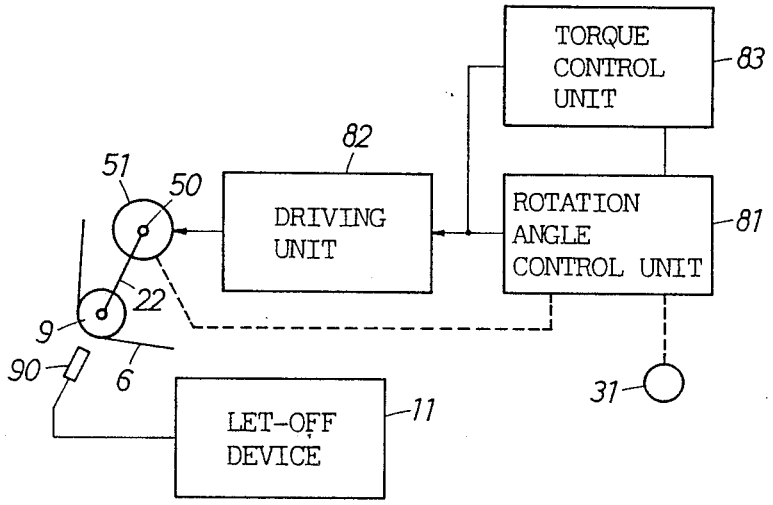
FIGS. 7 and 8 are block diagrams of essential portions of a seersucker loom in accordance with a fifth embodiment of the present invention.
Figure 8:
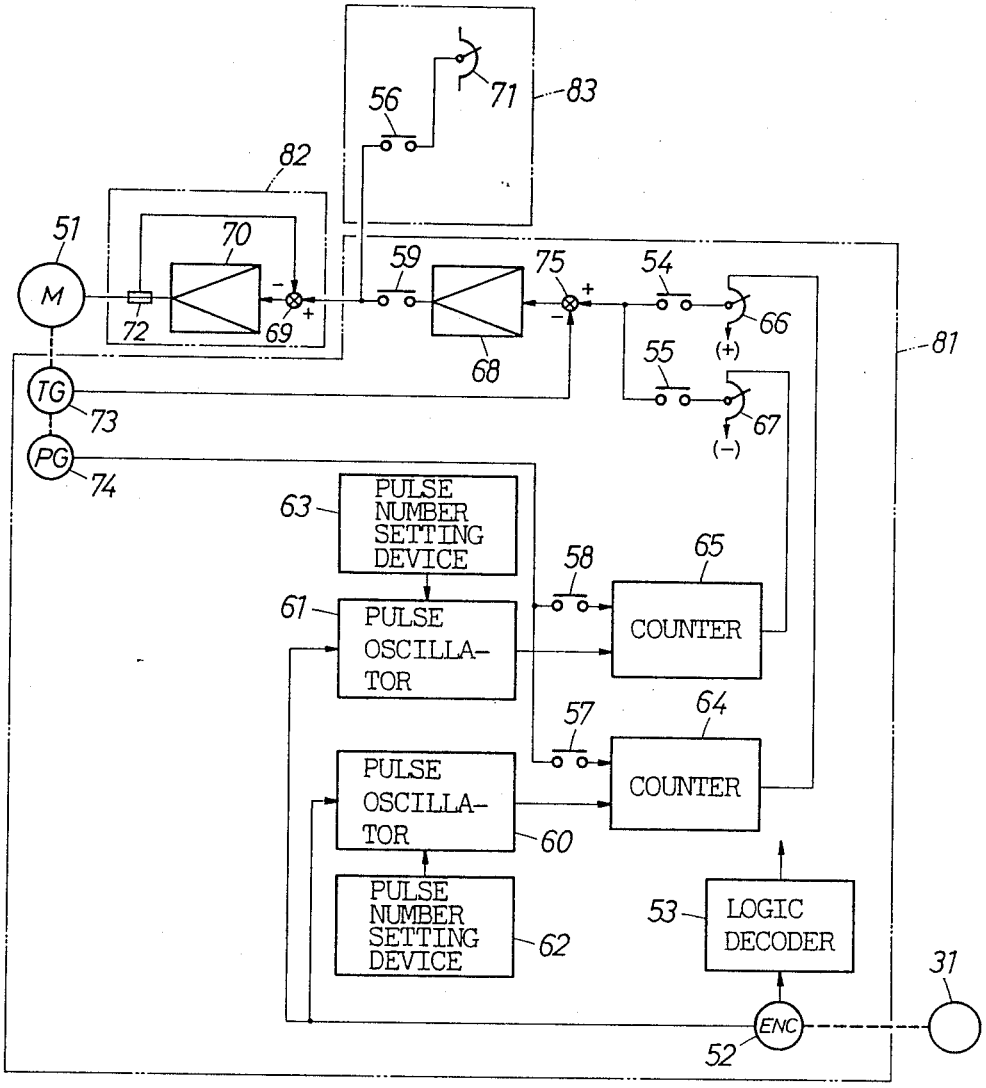
Figure 9:
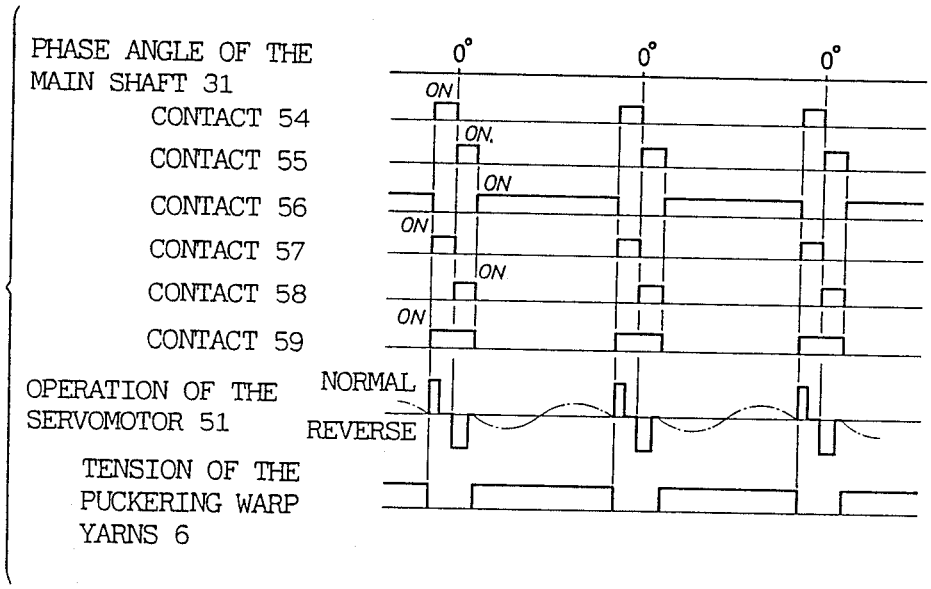
FIG. 9 is a time chart of assistance in explaining the operation of the seersucker loom of FIGS. 7.

Fifth Embodiment (FIGS. 7, 8 and 9)

Referring to FIG. 7, a tension regulating roller 9 is supported rotatably at the opposite ends thereof by swing arms 22. Each swing arm 22 has one end rotatably supporting the tension regulating roller 9 and the other end fixed to the output shaft 50 of a servomotor 51. The servomotor 51 swings the arm 22 to regulate the position of the tension regulating roller 9. The direction of rotation, angle of rotation and torque of the servomotor 51 are controlled by a rotation angle control unit 81, a driving unit 82 and a torque control unit 83.

The phase angle of the main shaft 31 if detected by an encoder 52 associated with the main shaft 31 (See FIG. 8). A logic decoder 53 connected to the encoder 52 controls contacts 54, 55, . . . and 59 for on-off operation as shown in FIG. 9. When the contacts 54, 57 and 59 are closed, the encoder 52 actuates a pulse oscillator 60. The pulse oscillator 60 generates a predetermined number of pulses set by a pulse number setting device 62 and corresponding to the displacement of the tension regulating roller 9 at a rate proportional to the rotating speed of the main shaft 31 to drive the servomotor 51 so that the tension regulating roller 9 is shifted in a direction to slacken the puckering warp yarns 6. The pulses generated by the pulse oscillator 60 are given to a counter 64 to set the counter 64. The output signal of the counter 64 is transmitted through a gain setting device 66 for improving its response characteristics, a summing point 75, an amplifier 68, a summing point 69 and a driving amplifier 70 to drive the servomotor 51 for operation in the normal direction during the short slackening period, whereby the swing arm 22 is turned counterclockwise, as viewed in FIG. 7, to shift the tension regulating roller 9 toward the cloth fell 5, so that the puckering warp yarns 6 are slackened. The torque of the servomotor 51 is determined by a torque setting device 71. A signal representing a set torque is fed through the contact 56 to the driving amplifier 70. Accordingly, the tension of the puckering warp yarns 6 is dependent on the torque of the servomotor 51.

During the foregoing puckering warp yarn slackening operation, the output of the driving amplifier 70 is detected by a current detector 72 and the output of the current detector 72 is applied to the summing point 69 as a feedback signal. The rotating speed of the servomotor 51 is detected by a tachometer generator 73 and the electrical output of the tachometer generator 73 is applied to the summing point 75 as a feedback signal. A pluse generator 74 generates a pulse signal representing the angle of rotation of the servomotor 51 and the pulse signal is supplied through the contact 57 to the down input terminal of the counter 64 to down-count the set number of the counter 64. Upon the completion of rotation of the servomotor through an angle corresponding to the pulse signal, the counter 14 reaches zero and the servomotor 51 is stopped automatically.

During the foregoing control operation, the beating-up motion is completed to weave the puckering warp yarns 6 of a length longer than that of the ground warp yarns 2 into the seersucker 18. Upon the completion of the beating-up motion, the logic decoder 53 keeps the contact 59 closed, opens the contacts 54 and 57, and closes the contacts 55 and 58. Then, a pulse oscillator 61 outputs a predetermined number of pulses set previously by a pulse number setting device 63 corresponding to the backward movement of the tension regulating roller 9 to a counter 65. Then, the output of the counter 65 is fed through a gain setting device 67 and the contact 55 to the driving amplifier 70 to drive the servomotor 51 for operation in the reverse direction, whereby the tension regulating roller 9 is returned to the initial position upon the completion of the beating-up operation to apply a predetermined tension again to the puckering warp yarns 6. Subsequently, only the contact 56 is closed and the rest of the contacts are opened and the driving amplifier 70 controls the torque of the servomotor 51 so as to be at a desired torque set by a torque setting device 71 to apply a tension slightly exceeding the lowest necessary tension for ensuring the smooth shedding motion of the puckering warp yarns 6.

The rotation angle control unit 81 and the torque control unit 83 function alternately in every picking cycle to slacken the puckering warp yarns 6 before beating-up operation and to tighten the puckering warp yarns 6 properly for a shedding operation. Thus, the servomotor 51 is alternately controlled by the rotation angle control unit 81 and the torque control unit 83 during one turn of the main shaft 31.

This electrical control system is free from inertial effects and is able to control the tension of the puckering warp yarns 6 at a response speed higher than that of the mechanical control system. Accordingly, the electrical control system is applicable to a high-speed seersucker loom. Furthermore, the electrical control system facilitates setting operations, such as a puckering ratio changing operation and a tension setting operation, which improves the flexibility of the seersucker loom. The electrical control system enables setting an optional torque control mode and an optional tension regulating mode through an electrical input operation to weave a seersucker having undulations of an optional pattern and hence the electrical control system is applicable to weaving various different seersuckers.

In the fifth embodiment, a sensor 90 detects the position of the tension regulating roller 9, and the let-off motion 11 controls the rotation of the upper beam 7 on the basis of the output signal of the sensor 90 indicating the position of the tension regulating roller 9 so that the tension regulating roller 9 is held always at a fixed position. Accordingly, the upper beam 7 lets off the puckering warp yarns 6 at a predetermined tension so that the puckering warp yarns 6 extend along a fixed passage, and at a fixed let-off rate.

Figure 10:
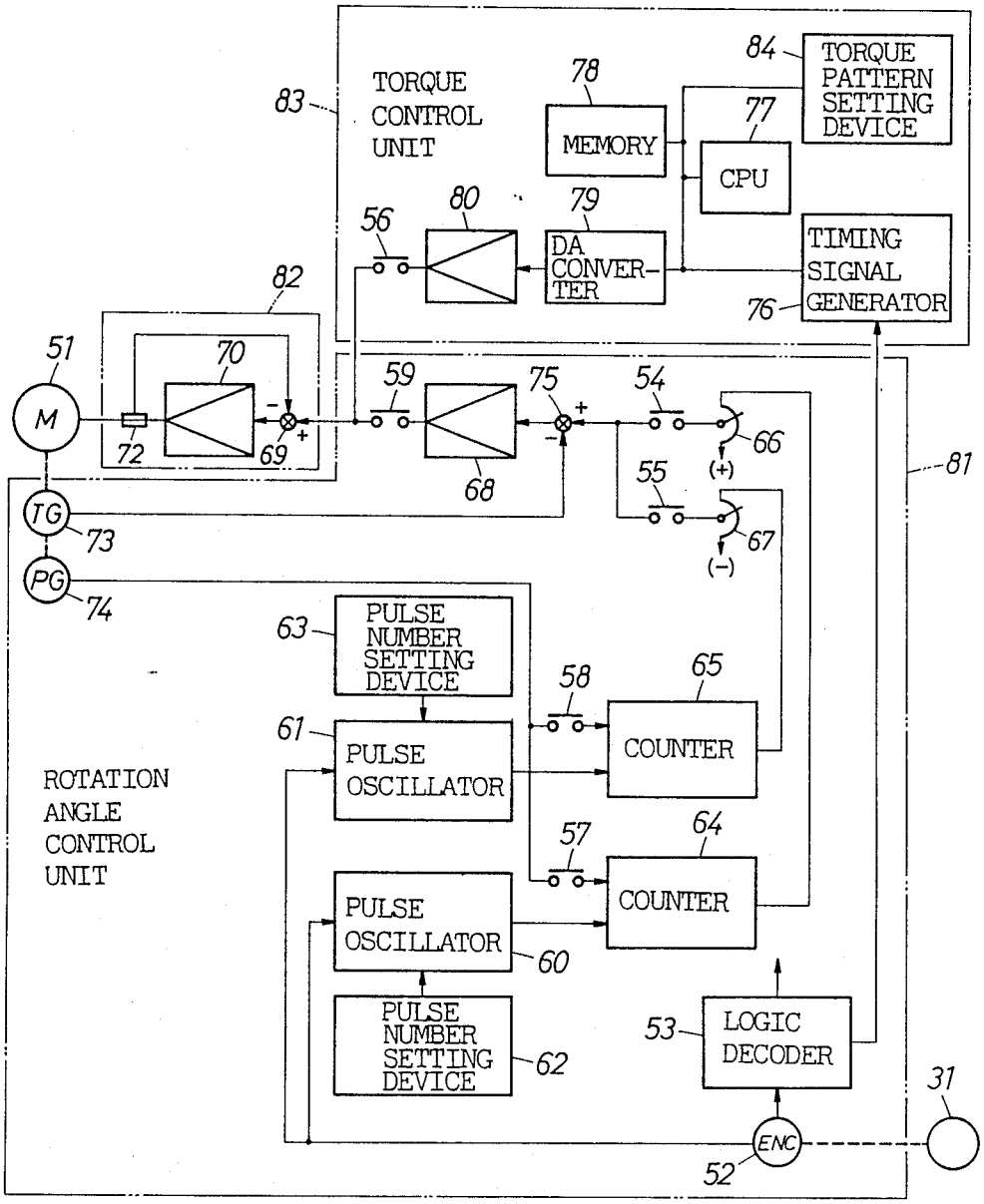
FIG. 10 is a block diagram of a control unit employed in a seersucker loom in accordance with a sixth embodiment of the present invention.
Figure 11:
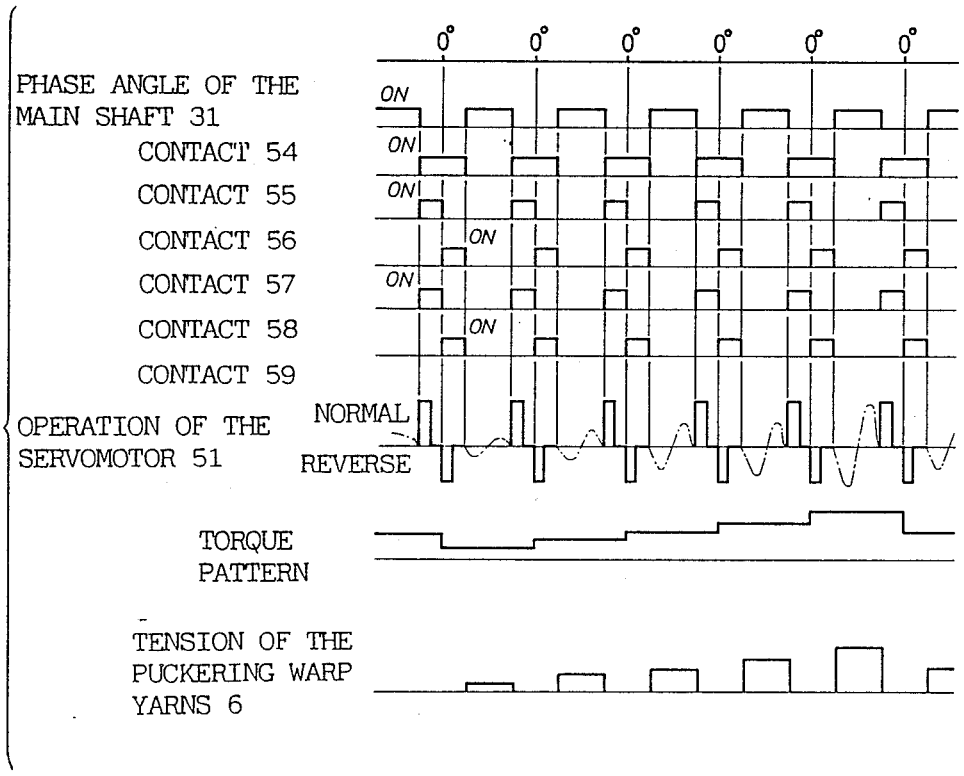
FIG. 11 is a time chart of assistance in explaining the operation of the seersucker loom of FIG. 10.

Sixth Embodiment (FIGS. 10 and 11)

In the fifth embodiment, the set torque of the servomotor 51 set by the torque setting device 71 is unchanged through the weaving operation. In the sixth embodiment, the desired torque of a servomotor 51 is varied periodically in synchronism with the rotation of the main shaft 31 of the loom.

Referring to FIG. 10, a logic decoder 53 outputs one pulse for every one full turn of the main shaft 31 to a timing signal generator 76 included in a torque control unit 83, and then the timing signal generator 76 gives a timing signal to a CPU 77. Then, the CPU reads a torque pattern previously stored in a memory 78 and outputs a desired torque to a D/A converter 79 once for every one full turn of the main shaft 31. An analog output signal provided by the D/A converter 79 is amplified by an amplifier 80, and then the amplifier 80 feeds the amplified analog signal through a contact 56 to a driving amplifier 70.

Thus, the desired torque ofthe servomotor 51 is changed once every one full turn of the main shaft 31 in a stepped torque pattern as shown in FIG. 11, so that the torque of the servomotor 51, hence the tension of the puckering warp yarns 6, is varied accordingly in a period around a moment when the warp is fully shed. The torque pattern is determined previously by a torque pattern setting device 84.

When the torque of the servomotor 51, hence the tension of the puckering warp yarns 6, is varied according to the torque pattern during the seersucker weaving operation, a periodically varying puckering pattern is formed, because the higher the tension of the puckering warp yarns 6, the more efficient is the slackening effect of the movement of the tension regulating roller 9. The periodic variation of the tension of the puckering warp yarns 6 produces, similarly to the tension control mode of the second embodiment, periodically varying undulations in the surface of the seersucker 18 corresponding to the periodic variation of the tension of the puckering warp yarns 6.

Figure 12:
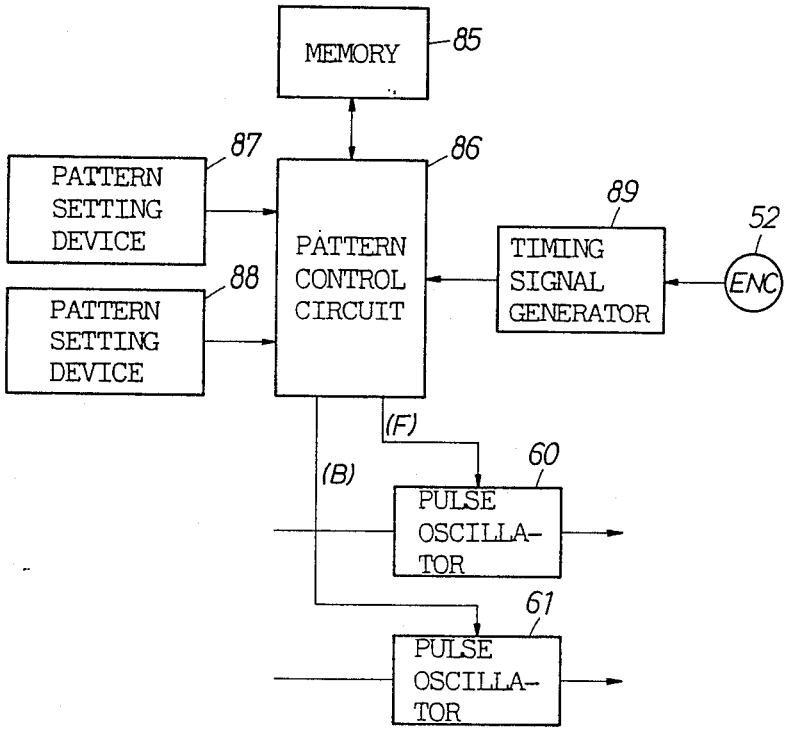
FIG. 12 is a block diagram of a control unit employed in accordance with a seersucker loom in a seventh embodiment of the present invention.

Seventh Embodiment (FIG. 12)

In the sixth embodiment, the tension of the puckering warp yarns 6 is varied periodically to weave a seersucker 18 having periodically varying undulations. Such periodically varying undulations of the seersucker 18 can be formed likewise by periodcally varying the angle of rotation of the servomotor 51, hence the slackening length of the puckering warp yarns 6.

FIG. 12 shows a control system for periodically varying the movement of the tension regulating roller 9 in synchronism with the rotation of the main shaft 31. A forward slackening length and a backward slackening length of the puckering warp yarns 6 are set by pattern setting devices 87 and 88, respectively, and the forward slackening length and the backward slackening length are stored in a memory 85. A pattern control circuit 86 reads the contents of the memory 85 in response to signals provided once every one full turn of the main shaft 31 by an encoder 52 associated with the main shaft 31 and a timing signal generator 89 and continuously controls the frequencies of pulse signals to be generated by pulse oscillators 60 and 61.

This control system varies the movement of the tension regulating roller 9 periodically in synchronism with the rotation of the main shaft 31. Consequently, the slackening length of the puckering warp yarns 6 varies, thereby periodically varying the slackening mode of the puckering warp yarns 6, so that undulations are formed in a pattern in the seersucker 18. The pattern of variable slackening length and the pattern of variable torque may be determined in conjunction with a pattern of box motion or a pattern of weft selection in weaving a multiple weft seersucker. Such a manner of determining the patterns of variable slackening length and variable torque gives the seersucker a varied structural effect.

Although the invention has been described in its preferred form with a certain degree of particularity, it is to be understood that many variations and changes are possible in the invention without departing from the scope thereof.

We claim:

1. A seersucker loom for weaving a seersucker by simultaneously letting off ground warp yarns at a let-off rate and puckering warp yarns at a let-off rate higher than that of the ground warp yarns, and interlacing the ground warp yarns and the puckering warp yarns with a weft yarn, said seersucker loom comprising: a main shaft; a tension regulating means disposed in the path of the puckering warp yarns for applying a predetermined tension to the puckering warp yarns; a driving means for moving said tension regulating means in a direction to slacken the puckering warp yarns, said driving means moving said tension regulating means in a direction to slacken the puckering warp yarns at least during a slackening period from a shed closing operation to a beating-up operation in every one full turn of said main shaft;

wherein said tension regulating means comprises a pair of swing levers, and a tension regulating roller rotatably supported on one end of each of the pair of swing levers; and wherein said driving means comprises a cam mechanism including a synchronizing means for moving said tension regulating roller in a direction to slacken the puckering warp yarns once every one full turn of said main shaft in synchronism with the rotation of said main shaft.

2. A seersucker loom for weaving a seersucker by simultaneously letting off ground warp yarns at a let-off rate and puckering warp yarns at a let-off rate higher than that of the ground warp yarns, and interlacing the ground warp yarns and the puckering warp yarns with a weft yarn, said seersucker loom comprising: a main shaft; a tension regulating means disposed in the path of the puckering warp yarns for applying a predetermined tension to the puckering warp yarns; a driving means for moving said tension regulating means in a direction to slacken the puckering warp yarns, said driving means moving said tension regulating means in a direction to slacken the puckering warp yarns at least during a slackening period from a shed closing operation to a beating-up operation in every one full turn of said main shaft;

wherein said tension regulating means comprises a pair of swing levers and a tension regulating roller rotatably supported on one end of each of the pair of swing levers; and wherein said driving means comprises a cam mechanism including a synchronizing means for moving said tension regulating roller in a direction to slacken the puckering warp yarns once every one full turn of said main shaft in synchronism with the rotation of said main shaft and for varying the movement of said tension regulating roller at a period corresponding to several turns of said main shaft.

3. A seersucker loom for weaving a seersucker by simultaneously letting off ground warp yarns at a let-off rate and puckering warp yarns at a let-off rate higher than that of the ground warp yarns, and interlacing the ground warp yarns and the puckering warp yarns with a weft yarn, said seersucker loom comprising: a main shaft; a tension regulating means disposed in the path of the puckering warp yarns for applying a predetermined tension to the puckering warp yarns; a driving means for moving said tension regulating means in a direction to slacken the puckering warp yarns, said driving means moving said tension regulating means in a direction to slacken the puckering warp yarns at least during a slackening period from a shed closing operation to a beating-up operation in every one full turn of said main shaft;

wherein said tension regulating means comprises droppers and wherein said driving means comprises support plates for supporting said droppers and an actuator for vertically moving said support plates.

4. A seersucker loom for weaving a seersucker by simultaneously letting off ground warp yarns at a let-off rate and puckering warp yarns at a let-off rate higher than that of the ground warp yarns, and interlacing the ground warp yarns and the puckering warp yarns with a weft yarn, said seersucker loom comprising: a main shaft; a tension regulating means disposed in the path of the puckering warp yarns for applying a predetermined tension to the puckering warp yarns; a driving means for moving said tension regulating means in a direction to slacken the puckering warp yarns, said driving means moving said tension regulating means in a direction to slacken the puckering warp yarns at least during a slackening period from a shed closing operation to a beating-up operation in every one full turn of said main shaft;

wherein said tension regulating means comprises a tension regulating roller rotatably supported by a pair of swing arms and wherein said driving means comprises a servomotor for swinging said swing arms to move said tension regulating roller in a direction to slacken the puckering warp yarns; a rotation angle control unit including a synchronizing means for controlling said servomotor for operation through a predetermined angle of rotation in synchronism with the rotation of said main shaft at least during a slackening period from the shed closing operation to the beating-up operation; a torque control unit for making said servomotor generate a predetermined torque during a period other than during the slackening period, and a driving unit for driving said servomotor according to said rotation angle control unit and said torque control unit.

5. A seersucker loom according to claim 4, wherein said torque control unit includes a torque varying means for periodically varying a value of said predetermined torque at a period corresponding to several turns of said main shaft.

6. A seersucker loom according to claim 4, wherein said rotation angle control unit includes a displacement varying means for periodically varying the displacement of said tension regulating roller at a period corresponding to several turns of said main shaft.

* * * * *